US005105878A

United States Patent [19]

Forest et al.

[11] Patent Number: 5,105,878

[45] Date of Patent: Apr. 21, 1992

[54] ELECTRICAL SYSTEM INCLUDING A CONNECTOR, CABLE AND CARTRIDGE FOR SLANT HOLE DRILLING

[75] Inventors: Frank C. Forest, Richmond; Thomas M. Wagner, III; Gailen D. Marshall, both of Houston, all of Tex.

[73] Assignee: Sharewell, Inc., Houston, Tex.

[21] Appl. No.: 477,720

[22] Filed: Feb. 9, 1990

[51] Int. Cl.[5] ..... E21B 19/22

[52] U.S. Cl. ..... 166/65.1; 166/77; 166/77.5; 166/385; 175/40; 175/61

[58] Field of Search ..... 175/40, 45–50, 175/57, 257; 166/385, 65.1, 77, 77.5, 85; 242/47.5, 159, 170; 254/134.3 R, 134.3 SC

[56] References Cited

U.S. PATENT DOCUMENTS 3,807,502 4/1974 Heilhecker et al. ..... 166/385 X
3,825,078 7/1974 Heilhecker et al. ..... 166/385 X
4,325,438 4/1982 Zuvela ..... 175/50

*Primary Examiner*—Stephen J. Novosad

*Attorney, Agent, or Firm*—Gunn, Lee & Miller

[57] ABSTRACT

A method for positioning an added length of wire in a drill string is set forth, and it is especially intended for use in drilling a slant hole, as typically occurs to drill under a river, or under other surface obstacles. A cartridge is disclosed; it has an upper flange at one end, a hook or eyelet across the flange to engage a hook and line for pulling the cartridge along the drill string, and further includes latching means for latching the cartridge at a specified location in a drill string. It further includes a spool for storage of wire, and the wire extends from an annular space for storage and the annular space is defined by a pair on concentric cylindrical sleeves. A method of use is also set forth wherein the cartridge is moved from drill pipe joint to joint and supports an elongate wire which is spooled therearound and which is pulled from the spool position. The wire, on emerging, encounters frictional drag to assure that only the wire length necessary is spooled out of the device.

10 Claims, 2 Drawing Sheets

FIG. 5
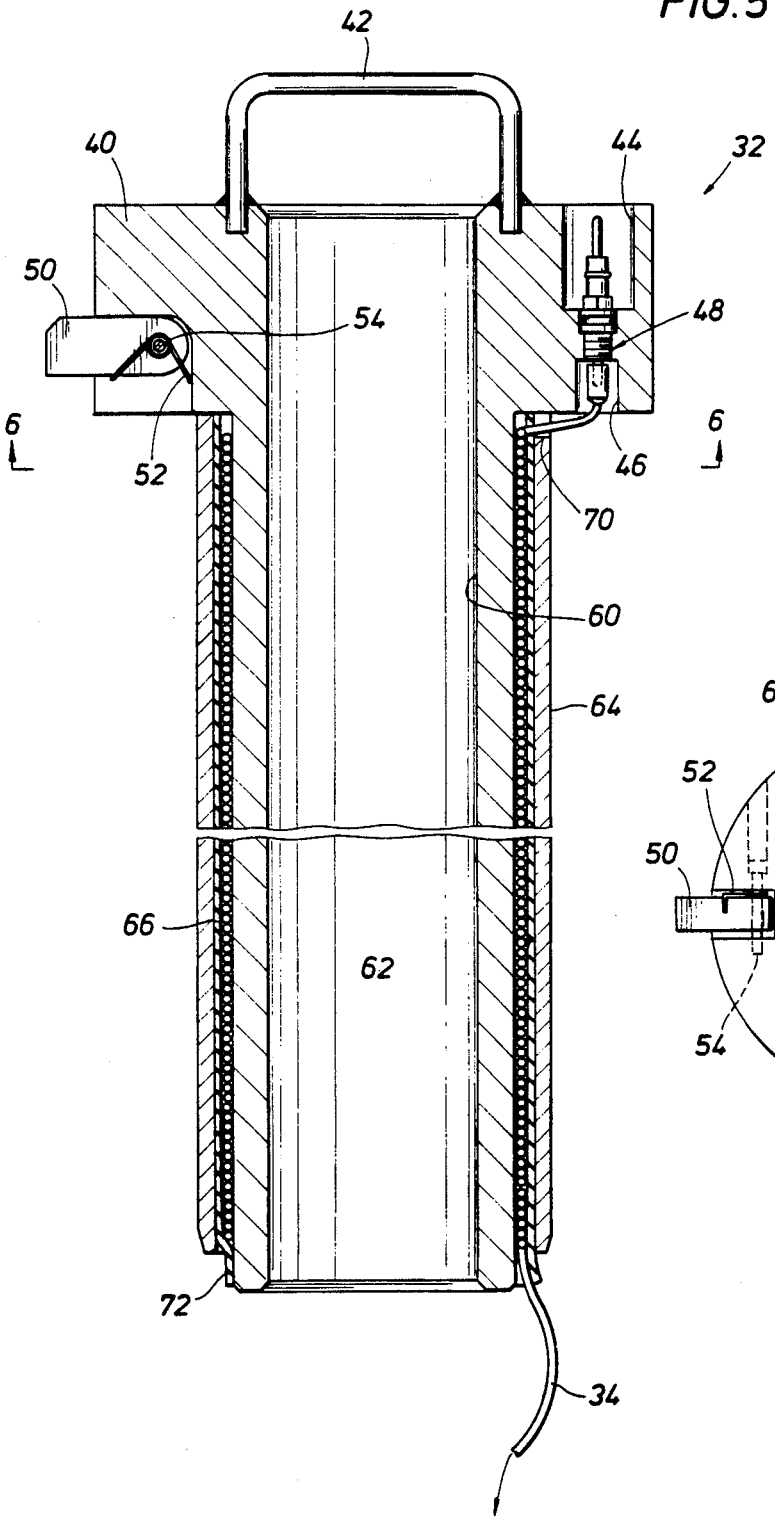
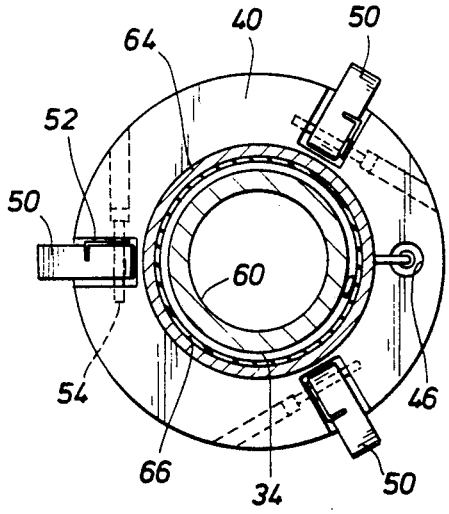
FIG. 6

ELECTRICAL SYSTEM INCLUDING A CONNECTOR, CABLE AND CARTRIDGE FOR SLANT HOLE DRILLING

BACKGROUND OF THE DISCLOSURE

This disclosure is directed to an apparatus for drilling slant holes. A slant hole is used to tunnel beneath rivers or similar areas. As one example, slant holes can be used to drill under highways and other areas where trenching activities are not acceptable. The slant hole is useful for going under areas where construction work is prevented or costly. In a typical situation, the hole that is drilled is formed at a very shallow angle with respect to the surface. As an example, the well may enter the surface at a slant angle while drilling. Drilling is accomplished by mounting a drive unit connected to a kelly which is rotated by the drive unit. This slant well drilling apparatus is not the same as a conventional well drilling apparatus which forms conventional oil or water wells. The kelly, in turn, is threaded to a first joint of drill pipe. As drilling progresses, additional joints of drill pipe are added between the drill string and the kelly. Moreover, the drilling process utilizes electrically powered and guided control mechanisms at the end of the drill string. The end of the drill string supports a drill bit and various steering devices which enable drilling in the desired direction. The equipment at the drill bit, including the steering device, requires an electrical connection. Ordinarily, this is accomplished by positioning an electrical cable through the drill string extending to the kelly which is a hollow member. Each time a joint is added, the electrical conductor must be cut, additional lengths spliced in it and it must be rethreaded through the added joint of pipe. The present disclosure is directed to an apparatus which reduces the number of cuts required for the conductor string and therefore expedites drilling speed. The present apparatus is incorporated within a drill string to enable quick connection and disconnection, and to further enable continued drilling.

The present disclosure is directed to an insert having the form of a cartridge with protruding lugs. It is axially hollow to provide a flow path through the device for drilling fluid. In the ordinary situation, drilling fluid is introduced through the kelly and is forced through the drill string and emerges from the drill bit. This flow forces electrical cables deployed in the drill string down the drill string to the drill bit. The present apparatus is a device which stores an excessive amount of electrical cable or wire, but it is spooled out slowly to avoid cable accumulation which would otherwise occur. It requires a specified pull on the cable which is held within a housing. The cable is pulled turn by turn from the housing and deployed in the drill string. This avoids bunching of the cable in the drill string.

Through the use of the present equipment, a connector is located in the drill string which enables quick and easy connection and disconnection as a joint of pipe is added. Moreover, the device is readily moved from a first joint of pipe into the new joint of pipe after the first joint has been drilled into the well. This procedurally speeds up the addition of another joint of pipe in the drill string.

The present apparatus is summarized as a cartridge which has protruding tabs or ears which extend outwardly at the top end. This enables it to be locked at a pin and box coupling in the drill string. It has a transverse bar which serves as a hook or eyelet for retrieval so that it can be pulled upwardly. The cartridge has a transverse top end which is drilled in the center with a passage of sufficient diameter to serve as a mud flow path for drilling fluid which is pumped through the drill string. It is relatively short, shorter than a typical joint of drill pipe. Moreover, the top end supports a fixed connector functioning as an electrical feedthrough. The top of the connector connects with an externally directed conductor. The bottom of the connector connects with a coil of wire which is stored in an internal cavity. The wire is sufficiently long to span several joints of drill pipe. It is stored and held out of the way between a pair of cylindrical tubular sleeves. The inner sleeve defines the axial mud flow path while the outer sleeve is concentric around the inner sleeve defining a narrow space. The coiled wire is pulled free through a resilient lip which retards feeding of the wire.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 5 is a sectional view longitudinally of the cartridge of the present disclosure showing its construction; and FIG. 6 is a sectional view along the line 6—6 of FIG. 5 showing details of construction of certain latches which are included to hold the cartridge at a specified depth in the well.

DETAILED DESCRIPTION OF THE PREFERRED EMBODIMENT

Figure 1:
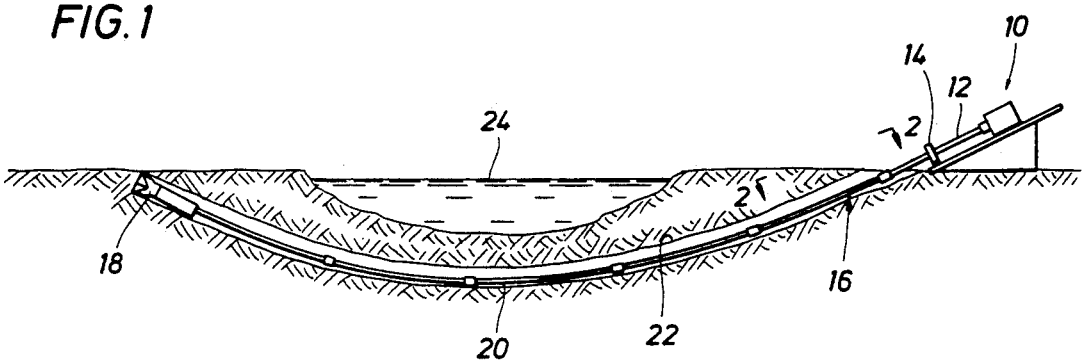
FIG. 1 shows a river crossing drilling procedure utilizing a kelly connected at the top end of a drill string formed of multiple joints of drill pipe and terminating at a drill bit with steering equipment wherein electrical power is required through a conductor in the drill string.

Attention is now directed to FIG. 1 of the drawings where a river crossing is being drilled. This will be explained to provide the context of the present apparatus and its method of use. In FIG. 1 of the drawings, a drilling system is generally identified at 10. It is typically mounted on a flat bed trailer which is sloped or tilted at a requisite angle to cause a kelly 12 to align at a particular angle with respect to the surrounding ground. The drill string penetrates the earth typically at a slant angle of perhaps of a few degrees. The kelly 12 is powered by the power plant in a fashion believed to be well known. It extends through a guide bushing 14, and is reciprocated on adding joints of pipe in the drill string. The drill string is identified generally by the numeral 16, and is made up of individual joints of pipe. There is a drill bit 18 at the remote end of the drill string. The drill bit typically is installed in conjunction with various steering tools. In general terms, the equipment at the drill bit 18 requires electrical power for operation. Accordingly, an electrical conductor is strung through the drill string. The present disclosure describes how this conductor can be placed in the drill string more readily.

The drill string 16 is made up of individual joints of drill pipe 20. They are constructed in accordance with industry standards to have pin and box connections at the two ends. They typically are about thirty feet in length. The steering tool, cooperative with the drill bit 18, deviates the slant hole 22. It is typically drilled subject to control of the steering tool so that it passes underneath a surface obstacle such as the river 24. Other surface obstacles can be avoided in similar fashion. It is not uncommon to direct the slant hole 22 for several hundred or several thousand feet. Slant holes can be drilled for a few thousand feet or more. Ordinarily, in drilling the slant hole, the drill string 16 provides an axial passage for drilling fluid which is pumped through the kelly 12 and into the drill string. It emerges from the drill bit and normally saturates the surrounding soil, forming a mud cake which defines the hole 22. It helps secure the side walls to prevent collapse after the drill bit has passed. Typically, the slant hole 22 is drilled in the fashion shown in FIG. 1 so that it traverses at a controlled depth below the surface of the ground and the two ends of the slant hole 22 may be exposed at controlled locations several thousand feet apart.

One routine involves the drilling of the slant hole to complete a river crossing of a pipeline. It is desirable that the pipeline be buried well below the water level in the river. As an example of one such installation, the drill pipe might have a nominal measure of five and one half inches while the drill bit forms a hole of about nine and one half inches. The pipeline to be installed might be larger such as a twelve inch pipeline. When the drill bit 18 emerges at the remote end of the slant hole 22, it is removed, and a reamer is then attached. The reamer is also connected with the twelve inch pipe making up the pipeline. The drilling equipment is then used to pull the drill string 16 back out of the hole. In backing out, the reamer cuts the hole larger to the diameter necessary to receive and hold the pipeline which is then installed. The pipeline is installed as the reamer is pulled from the slant hole. This procedure involves removal of the drill string joint by joint. This proceeding can be carried out without electrical power required for the drill bit.

Figure 2:
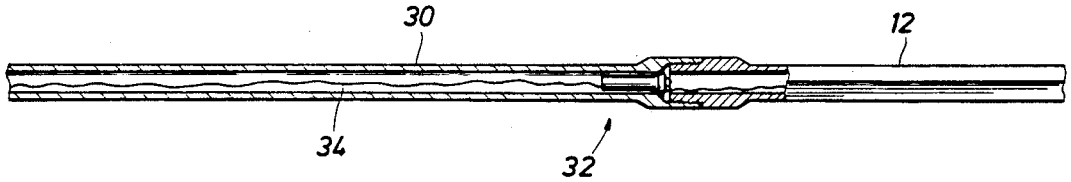
FIG. 2 is a sectional view through a portion of the drill string showing the present apparatus located at the top most joint of drill pipe just below the kelly and further showing a conductor extending from the cartridge of this disclosure to the lower end of the drill string.
Figure 3:
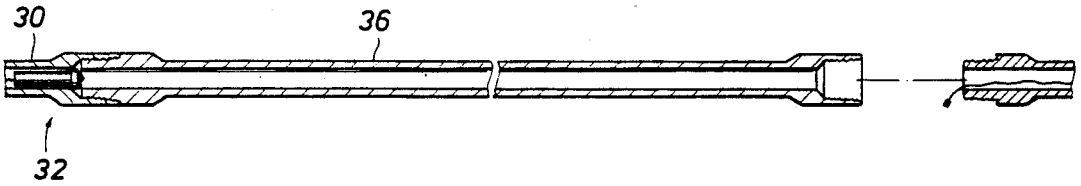
FIG. 3 is a view similar to FIG. 2 showing a first joint of drill pipe which has been drilled down, a second joint added in the drill string and further showing the cartridge of the present disclosure prior to pulling the cartridge through the second joint of pipe.

Attention is now directed to FIG. 2 of the drawings. There, the top most joint of pipe is identified by the numeral 30. It is threaded to the kelly 12. The present disclosure is generally identified by the numeral 32. It is inserted at the end of the pipe 30 and catches so that it is held. The pipe and kelly are joined with the conventional pin and box connection. The cartridge 32 extends an electrical conductor 34 in a fashion to be described in detail hereinafter. Compare FIGS. 2 and 3; in FIG. 2, the kelly is connected to the pipe 30. In FIG. 3, an additional joint 36 has been added to the drill string. The joint 36 is added by first breaking the threaded connection between the kelly 12 and the pipe 30. After breaking the threaded connection, the kelly is retracted for clearance whereby the pipe joint 36 can be inserted in the drill string. It is threaded to the pipe 30 with a conventional pin and box connection. The upper end of the pipe 36 is left clear of connection for the moment for additional procedures to be carried out. At this point, the cartridge 32 of the present disclosure is still located in the pipe joint 30. The procedure of the present disclosure envisions placing a rope or line with a hook in the pipe 36. The line 38 supports a hook which hooks the cartridge 32 and pulls it upwardly through the pipe joint 36. It is constructed so that it can be pulled with the soft line 38.

Figure 4:
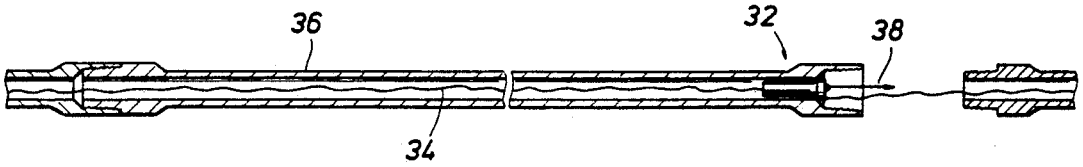
FIG. 4 is a view similar to FIG. 3 showing the cartridge after it has been pulled up in the drill string so that it is now at the top end of the second joint of pipe, and further including the kelly which is then connected to continue drilling.

As shown in the contrast of FIGS. 3 and 4, when the cartridge is pulled up, the conductor 34 is strung through the new joint of pipe.

The cartridge 32 is shown in greater detail in FIG. 5 of the drawings. There, the cartridge is shown to be formed of a top circular flange 40 which has a handle 42 thereabove. The handle or eyelet is for gripping a hook on the end of the rope or line 38. The flange 40 has holes at 44 and 46 which surround an electrical feedthrough connector 48. At the top end, it connects with a surface located conductor extended through the kelly. At the lower end, the connector 48 joins to the wire 34. In other words, the feedthrough connector 48 can be broken at the top end and bottom end. The feedthrough is used so long as the cartridge 32 is in the system. As first one cartridge and then the next is exhausted of cable, cable segments are interconnected by connectors not involving the feedthrough 48.

The flange 40 supports at least two, preferably three or four protruding latches 50. The latch 50 extends outwardly and is forced outwardly by a bias spring 52. It is rotated on a shaft 54, the shaft spanning a notch or recess 56. The latch is able to rotate approximately ninety degrees. The bias spring forces it outwardly as shown in FIG. 5. It can be forced to rotate where it points downwardly in FIG. 5. This enables the cartridge 32 to be pulled relatively upwardly through a joint of pipe. Because the latch extends, the device cannot fall down the pipe. The latches are sized in conjunction with other dimensions of the cartridge so that the latches extend and hold in the pipe when the cartridge 32 catches at the pin and box coupling.

The cartridge is constructed with two concentric cylindrical sleeves. The inner sleeve is affixed to the flange plate 40. It is identified by the numeral 60. The sleeve 60 is on the interior and defines a mud flow passage 62. The passage 62 extends the length of the cartridge. There is a second sleeve 64. The sleeve 64 is concentric to the first sleeve 60. An annular gap between the two is defined. The gap is partially filled by means of a resilient liner sleeve 66 between the two sleeves. The liner sleeve frictionally engages the bights of the coiled wire 34. A port 70 permits the wire 34 to be extended from the feedthrough connector 48 into the space between the two cylindrical members 60 and 64. The gap is sized so that the wire fits in the gap snugly, and the bights are wound in the gap rather tightly. This frictionally grips the wire 34. The wire typically is a multi-conductor cable which is formed of one or more electrical conductors, each of which is electrically insulated, and the wire has an outer sleeve which defines it as a generally round member. The wire extends downwardly as it emerges from the gap between the two sleeves 60 and 64. The resilient liner 66 is biased to define a closure lip 72. This lip fits snugly around the sleeve 60. The wire is pulled downwardly through this lip. As the bights of the wire are pulled downwardly, the wire emerges from the gap adjacent the resilient lip 72 and unspools something in the fashion of a spinning reel. The unspooled wire, however, does not come out freely; rather, there is a drag encountered because the liner 66 grips the wire and holds it against the sleeve 60. This assures that the wire cannot spool freely through the gap at the lower end of the cartridge 32.

The cartridge is relatively easy to assemble. In the initial assembly sequence, the wire 34 is connected to the feedthrough 48 and then is wrapped around the exposed exterior surface of the sleeve 60. It is wrapped around this from one end to the other. After the cylinder 62 has been wrapped to the lower end, the next step is to slide the resilient sleeve 66 over the wire and to position the outer metal sleeve 64 on the exterior. The latter two components can be bonded together as desired so they slide as a unit over the wire wrapped cylinder 60. The notch 70 is aligned so that it will be properly positioned relative to the feedthrough 48 and the upper end of the wire 34. When assembled, the wire 34 hangs from the lower end of the device, the multiple bights of the wire being looped around the sleeve 60 and the wire can thereafter be pulled free, but only on exerting a specified pull.

The cartridge 32 will typically store enough wire to span many joints of pipe. Actual cartridge storage capacity is a scale factor depending on the size of the wire, the gap for receiving the wire and the length of the cartridge. In the preferred embodiment, the cartridge should not exceed the length of a joint of the drill pipe. The latches 50 should extend outwardly and therefore have an extended diameter sufficient to lock against the top end of the drill pipe, namely, at the box end where entry into the stem of the pipe is prevented. The axial passage is preferably sized so that fluid flow is not restricted during use. In use, when the drill string is first assembled, it comprises only the kelly, one joint of pipe and the drill bit and associated apparatus, and the cartridge 32 is positioned in the only joint of pipe and the conductor 34 is extended downwardly to connect with the steering equipment and other electrical power consuming equipment at the lower end of the drill string. The cartridge is then pulled from the first joint of pipe into the next joint of pipe after drilling down the first joint. The sequence of adding pipe is suggested in FIGS. 2, 3 and 4. As the first joint 30 is drilled down, the threaded connection with the kelly 12 is broken and the next joint of pipe 36 is then prepared for positioning in the drill string. The joint 36 is ideally first threaded with a soft line 38 which has a hook on the bottom of the line, and that hook is engaged with the eyelet 42, shown in FIG. 5. This strings the joint 36 on the soft line, so to speak. The threaded connection is made as shown in FIG. 3 and the cartridge is then pulled upwardly through the drill string. It is pulled to the position shown in FIG. 4, namely, where the latches pop out and extend into the box end and connection can now be made. In other words, the cartridge 32 is pulled up as shown in FIG. 4, latches at that point in the drill string and is secure against falling down the drill string. The wire 34 has been pulled out sufficiently to span the length of the joint 36. The feedthrough connector 48 is used to connect and disconnect so that electrical power is provided through the wire and that connection is thus shown in FIG. 4 also. The soft line 38 is disconnected after the cartridge has been landed. The kelly is then threaded into the drill string as suggested at the right hand end of FIG. 4. Further drilling then occurs. This drills down the joint 36 until another joint of pipe has to be added.

Ultimately, the cartridge 32 is depleted of cable. At that time, it can be discarded, and a second cartridge installed which is loaded with cable. The cable in the single cartridge is typically enough to span many joints of pipe. These electrical connections are made and unmade more readily. So, the first cartridge is depleted, leaving the cable 34 hanging out of the drill string whereupon the next cartridge is brought into play. The next cartridge is connected by connecting the wire 34 from it to the wire already in place in the drill string. The number of wire to wire connections which are exposed on the interior of the drill string is markedly reduced. This enables the operator to install the second cartridge in the drill string for operation in the illustrated fashion.

When drilling fluid flows through the drill string, it creates a downward pull on the wire. The wire does not pull free of the cartridge because the wire is gripped by the lip 72 and held tightly. This tight grip places controlled drag on the cable as the cable is pulled out of the cartridge. In drilling 1,000 feet, approximately thirty-three joints of pipe are required. In the old approach, this required approximately sixty-six electrical connections in the electrical cable strung through the drill string. The present invention reduces the electrical splices to only three or four. In this example, greater speed is accomplished by using this apparatus to speed up drilling down joint after joint. Operator speed is markedly enhanced by the present procedure. One estimate is that the present apparatus will decrease rig down time and add about two hours of drilling time per day in a typical situation.

What is claimed is:

1. An apparatus for adding wire into a drill string to add length to a signal communication wire in the drill string, the apparatus comprising:

(a) an elongate spool sized to fit within a drill string assembled from a plurality of drill pipe joints for supporting a drill bit at one end thereof; and (b) a wire storage chamber supported by said spool for receiving a length of wire where the wire has two ends, one for the ends being adapted to be connected nearer the drill bit end thereof, and the other end thereof being adapted to be connected nearer the surface end of the drill string, said wire storage chamber chamber being defined between a pair of concentric elongate sleeves, said sleeves defining a wire receiving cavity therebetween of annular shape, and said wire being coiled in bights within said cavity.

2. The apparatus of claim 1 including lock means for holding said elongate spool at a specified location within said drill string wherein said lock means prevent downward movement along the drill string by extending when said cartridge enters a pin and box coupling and without restricting upward movement along the drill string.

3. The apparatus of claim 2 including means gripping the wire to retard removal from said wire storage chamber.

4. The apparatus of claim 1 including an electrical connection which is connected to the wire from the wire storage chamber, and said wire and connector enable connection of the wire to additional cable in the drill string above said spool and said connector, said cable being independent from pulling means for moving said spool within the drill string.

5. The apparatus of claim 1 wherein said spool is an elongate hollow cylindrical member providing an axial flow path therethrough lengthwise of the apparatus, and further defines a passage to allow drilling fluid to flow through said spool in operation.

6. The apparatus of claim 1 wherein said spool includes an eyelet means for connection of said spool to pulling means for moving said spool within the drill string.

7. An apparatus for enabling the extension of a signal communication wire in a drill string, the apparatus comprising:

(a) an elongate spool sized to fit within a drill string assembled from a plurality of drill pipe joints; and (b) a wire storage chamber supported by said spool for receiving a length of wire where the wire has two ends, one for the ends being adapted to be connected nearer the drill bit end thereof, and the other end thereof being adapted to be connected nearer the surface end of the drill string; and (c) means gripping the wire to retard removal from said wire storage chamber.

8. The apparatus of claim 7 including lock means for holding said elongate spool at a specified location within said drill string wherein said lock means prevent downward movement along the drill string by extending when said cartridge enters a pin and box coupling and without restricting upward movement along the drill string.

9. An apparatus for enabling the extension of a signal communication wire in a drill string, the apparatus comprising:

(a) an elongate spool sized to fit within a drill string assembled from a plurality of pipe joints where said spool is an elongate hollow cylindrical member defining an axial passage to allow drilling fluid to flow through said spool in operation; and (b) a wire storage chamber supported by said spool for receiving a length of wire where the wire has two ends, one for the ends being adapted to be connected nearer the drill bit end thereof, and the other end thereof being adapted to be connected nearer the surface end of the drill string.

10. The apparatus of claim 9 including lock means for holding said elongate spool at a specified location within said drill string wherein said lock means prevent downward movement along the drill string by extending when said cartridge enters a pin and box coupling and without restricting upward movement along the drill string.

* * * * *